US006027042A

United States Patent [19]

Smith

[11] Patent Number: 6,027,042

[45] Date of Patent: Feb. 22, 2000

[54] ACTUATOR ASSEMBLY WITH VARIABLE SPRAY PATTERN

[75] Inventor: Jeremy P. Smith, Loudon, N.H.

[73] Assignee: Summit Packaging Systems, Inc., Manchester, N.H.

[21] Appl. No.: 09/170,778

[22] Filed: Oct. 13, 1998

[51] Int. Cl.[7] ..... B05B 7/32

[52] U.S. Cl. ..... 239/337; 239/391; 222/402.17

[58] Field of Search ..... 239/390–94, 396, 239/337; 222/402.1, 402.13, 402.17

[56] References Cited

U.S. PATENT DOCUMENTS

| | | | |
|---|---|---|---|
| 55,285 | 6/1866 | Gurley . | |
| 259,131 | 6/1882 | Gould . | |
| 2,345,812 | 4/1944 | Harriman et al. | 299/129 |
| 2,345,813 | 4/1944 | Harriman et al. | 299/135 |
| 2,382,066 | 8/1945 | Klein | 299/145 |
| 2,484,942 | 10/1949 | Guise | 169/1 |
| 2,797,965 | 7/1957 | McKernan . | |
| 3,170,606 | 2/1965 | Boyer | 222/394 |
| 3,198,394 | 8/1965 | Lefer | 222/135 |
| 3,258,208 | 6/1966 | Greenbaum, II . | |
| 3,284,007 | 11/1966 | Clapp . | |
| 3,703,994 | 11/1972 | Nigro | 239/397 |
| 3,711,030 | 1/1973 | Jones . | |
| 3,743,189 | 7/1973 | Macquire-Cooper . | |
| 3,795,366 | 3/1974 | McGhie et al. . | |
| 3,863,816 | 2/1975 | Focht . | |
| 3,891,128 | 6/1975 | Smrt | 222/402.17 |
| 3,961,756 | 6/1976 | Martini . | |
| 3,994,442 | 11/1976 | Hoening . | |
| 4,690,312 | 9/1987 | Crapser et al. | 222/402.17 |
| 4,706,888 | 11/1987 | Dobbs . | |
| 4,858,792 | 8/1989 | De Laforcade | 222/402.1 X |
| 4,989,790 | 2/1991 | Martin et al. . | |
| 5,337,926 | 8/1994 | Drobish et al. | 222/309 |
| 5,372,311 | 12/1994 | Nye . | |
| 5,655,691 | 8/1997 | Stern et al. | 222/402.1 |
| 5,664,732 | 9/1997 | Smolen, Jr. et al. | 239/121 |

*Primary Examiner*—Kevin Weldon
*Assistant Examiner*—Sean P. O'Hanlon
*Attorney, Agent, or Firm*—Davis and Bujold

[57] ABSTRACT

An actuator assembly for an aerosol container provided with a stem. The actuator assembly controls the dispensing of an aerosol product from the container. The actuator assembly includes a base which supports an actuator within a through-bore of the base in a cantilevered fashion. The actuator is provided with a primary discharge orifice for discharging the product from the aerosol container in a first spray configuration. The actuator assembly includes a secondary actuator mechanism which, when in an inactive position, allows the primary discharge orifice to control solely the discharge of the product to be dispensed from the aerosol container. The secondary actuator mechanism, when in a second active position, communicates with the primary discharge orifice and controls the spray configuration of the product to be dispensed as it is dispensed from the aerosol container. The secondary actuator mechanism can either be pivotally attached to the actuator assembly or completely removable therefrom.

20 Claims, 5 Drawing Sheets

ACTUATOR ASSEMBLY WITH VARIABLE SPRAY PATTERN

FIELD OF THE INVENTION

This invention relates to an improved actuator assembly, for an aerosol valve, with a rotatable or movable secondary actuator mechanism for changing the spray pattern of a fluid being dispensed from an aerosol valve and, more particularly, to a secondary actuator mechanism having at least two distinct spray dispensing positions.

BACKGROUND OF THE INVENTION

Over the years, various types of spray caps, actuator assemblies and mechanisms for controlling the dispensing of fluid from a pressurized aerosol spray canister have been manufactured. Such caps, assemblies and mechanisms have been used to achieve different volumetric spray rates as well as impart a desired spray pattern and/or particle size to the dispensed fluid.

Particular spray patterns are necessary or desired, for example, for aerosol canisters which dispense cleaning supplies such as a carpet cleaner. It is desirable, when spraying an area of a carpet, to utilize a wide spray pattern so as to cover a substantially large spray area during a relatively short period of time. However, in the situation where a carpet has localized staining or soiling, for example, it is desirable to dispense a concentrate, focused spray at the localized stained or soiled area.

Creating a desired spray pattern for a fluid emanating from a fluid flow control device is generally fairly well known in the industry. For example, U.S. Pat. No. 55,285 issued to Gurley discloses a pivotable spreader attachment for a fire hose for spreading a stream of water issuing from the hose in a wide angled pattern in order to cover a substantial area of the fire. The spreader consists of a pivoting spray head attached to the end of the hose which can be pivoted out of the way of the stream of water to allow a solid stream of water to issue out of the hose. When the spreader is re-engaged in its housing, water is forced through the spray head and sprayed in a fan-like pattern to cover a wide area of fire.

U.S. Pat. No. 3,994,442 to Hoening, discloses a spray cap having a swirl chamber and communicating passageways particularly sized for various substances to be dispensed from the spray can. In this reference, a particular orifice is conformed to the size needed for the effluent to efficiently issue from the valve body at a relatively high rate and in a predetermined pattern. While this shows the different size orifices, passageways and spray caps must be molded to accept particular fluid products, it does not indicate any method of switching or changing the spray pattern of the issuing fluid product from a single actuator cap.

U.S. Pat. No. 3,284,007 to Clapp is an example of an actuator cap which can be interchangeably upended and switched between either end of a single passageway in the actuator cap. Both ends are adaptable to the cans valve stem and both ends effect the issuing fluid in a particular manner providing varying flow characteristics to the issuing product.

U.S. Pat. No. 3,863,816 to Focht discloses a variable flow rate actuator button having separate longitudinal feed grooves in the side wall of a rotating internal plug. The separate grooves allow for variable flow rate communication between the valve stem and the discharge orifice of the actuator. While Focht '816 shows an apparatus for changing the flow rate of a fluid, it does not indicate a method of changing the spray pattern.

U.S. Pat. No. 3,711,030 issued to Jones is a multiple pattern spraying apparatus. Jones '030 shows a spray cap which can dispense a working fluid from an aerosol can in a plurality of spray patterns. Jones '030 provides an indexed spray head which rotates about an axis which is parallel to, but offset from the axis of the valve stem. The spray head contains a plurality of nozzle outlets, each of these outlets has an associated passageway which must be moved independently into communication with the valve stem in order to allow passage of the fluid from the container out of the selected nozzle.

SUMMARY OF THE INVENTION

It is the object of the present invention to provide an improved actuator assembly, for an aerosol valve, with a removable or rotatable secondary actuator mechanism for varying the spray pattern of a fluid being dispensed from an aerosol valve supported by a pressurized container.

Another object of the invention is to provide a simple and efficient mechanism for altering the spray pattern of a dispensed pressurized spray which is relatively cheap and easy to manufacture.

Still another object of the invention is to provide a secondary actuator mechanism which can be manually operated by a user to instantaneously change the spray pattern, of a product dispensed from an aerosol spray canister, from a concentrate conical spray to wide fan-shaped spray and vice versa, as desired.

A further object of the invention is to provide an actuator cap or assembly for a pressurized container which has a single dispensing channel for discharging the product to be dispensed from the pressurized container to the external environment.

A still further object of the invention is to provide a primary discharge orifice which has an opening of a desired shape to facilitate discharge of the product to be dispensed in a primary spray pattern.

Yet another object of the invention is to provide a secondary actuator mechanism, supportable by a top surface of the actuator cap or assembly, for superimposing at least one secondary discharge orifice, having a different shape from the primary orifice, to facilitate discharge of the product to be dispensed in a secondary spray pattern which is different from the primary spray pattern.

Still another object of the invention is to provide a secondary actuator mechanism which, when the secondary discharge orifice is superimposed over the primary discharge orifice, creates a fluid tight seal between the primary and secondary discharge orifices so that all of the product dispensed by the primary discharge orifice is conveyed directly to the secondary discharge orifice where the product is dispensed in the second spray pattern.

The present invention relates to an improved actuator by simply and economically superimposing a secondary discharge orifice onto and over the conventional or primary discharge orifice of an aerosol spray cap to vary the fluid spray pattern emanating from the cap. The present invention allows a user to instantaneously change the fluid spray pattern between at least two separate patterns on a single spray cap in order to achieve a more specialized fluid application.

The present invention relates to an actuator assembly for an aerosol container having a stem for controlling dispensing of an aerosol product, the actuator assembly comprising: a base defining a longitudinal axis of the actuator assembly and having a through bore extending therethrough, and the base having an annular mechanism for attaching the base to a mounting cup of an aerosol container containing an aerosol product; and an actuator being located within the through bore of the base, the actuator being cantilevered to the base to facilitate pivoting of the actuator relative to the base, and the actuator having a product inlet and a primary discharge orifice, both communicating with one another, for dispensing the aerosol product out through the primary discharge orifice when the actuator assembly is attached to an aerosol container and sufficiently depressed; wherein the actuator assembly includes a secondary actuator mechanism provided with a secondary discharge orifice, and the secondary actuator mechanism, when in a first inactive position in which the secondary discharge orifice of the secondary actuator mechanism is sufficiently spaced from the primary discharge orifice so that a spray configuration of the aerosol product to be dispensed is controlled solely by the primary discharge orifice, and when the secondary actuator mechanism is in a second active position, located adjacent the primary discharge orifice, the primary discharge orifice supplies the aerosol product to be dispensed to the secondary discharge orifice where the spray configuration of the aerosol product to be dispensed is altered by the secondary discharge orifice as the product exits the actuator assembly.

BRIEF DESCRIPTION OF THE DRAWINGS

The invention will now be described, by way of example, with reference to the accompanying drawings in which.

DESCRIPTION OF THE PREFERRED EMBODIMENTS

Figure 1:
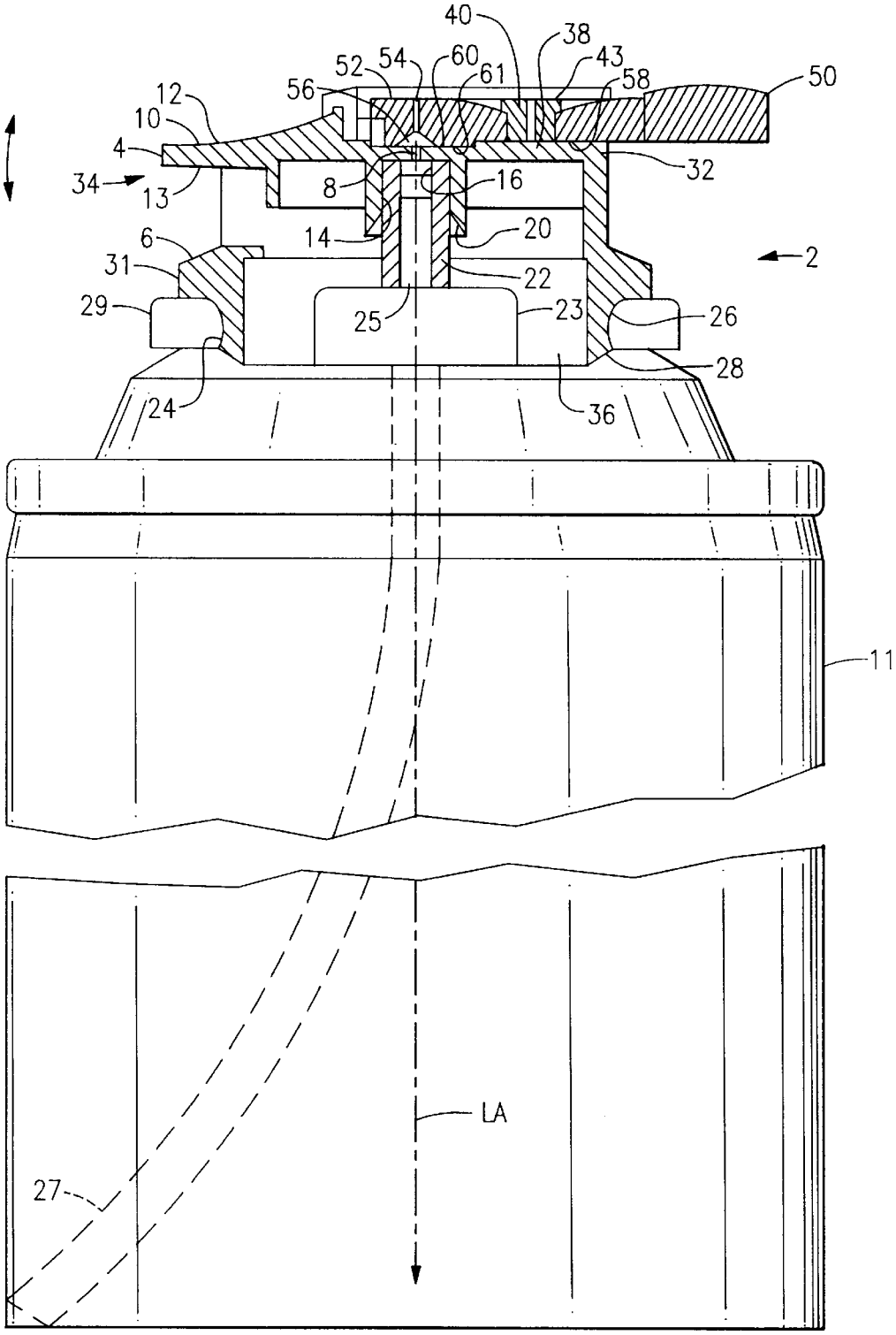
FIG. 1 is a diagrammatic cross-sectional view of the actuator assembly according to the present invention, affixed to an aerosol container.
Figure 3:
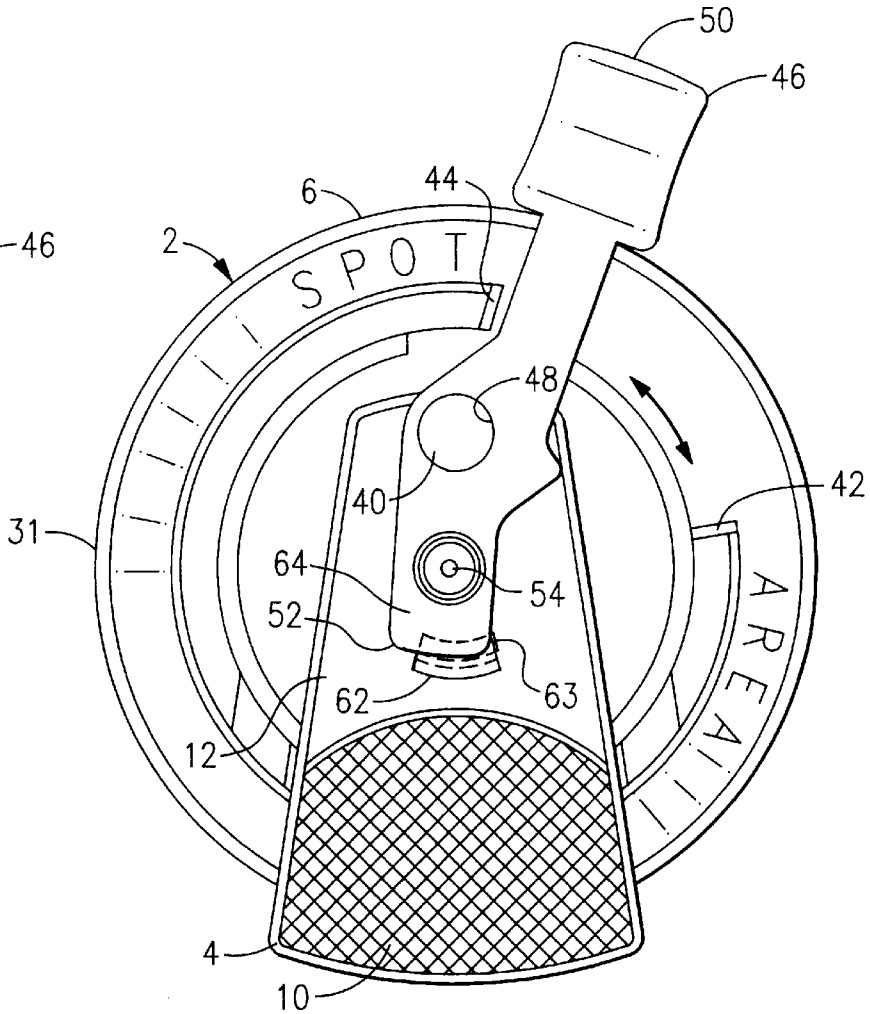
FIG. 3 is a diagrammatic top plan view of only the actuator assembly of FIG. 1 shown in an active position, superimposed over the primary discharge orifice.
Figure 2:
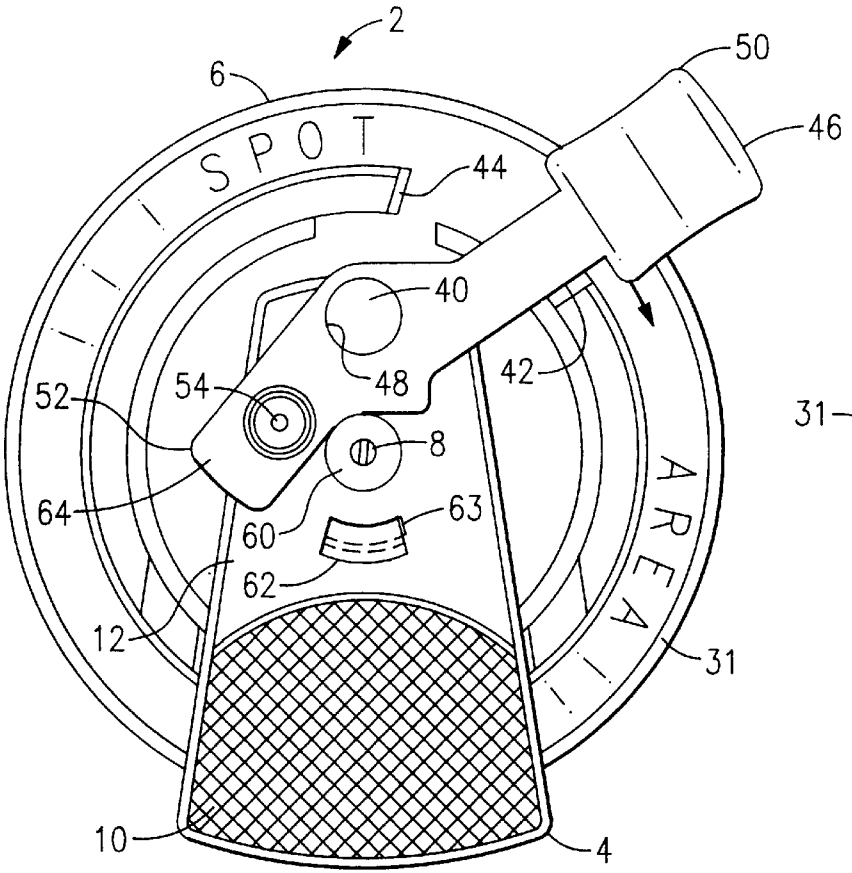
FIG. 2 is a diagrammatic top plan view of only the actuator assembly of FIG. 1 shown in an inactive position.

Turning now to FIGS. 1–3, a detailed description concerning a first embodiment of the present invention will now be provided. As can be seen in those Figures, the actuator assembly 2 includes an actuator 4 supported by a base 6 in a cantilevered fashion, i.e. to facilitate pivoting motion of the actuator 4 relative to the base 6. The actuator 4 has a centrally disposed primary discharge orifice 8 and has a contoured finger recess 10, formed in a top surface 12 of the actuator 4. The finger recess 10 facilitates depression of the actuator 4 by an index finger, for example, of a user once the actuator cap 2 is installed on a suitable aerosol container 11 to dispense the product contents of the aerosol container 11 via the centrally disposed orifice 8. The finger recess 10 can include a plurality of parallel spaced apart grooves or some other conventional arrangement to minimize slip of a finger when depressing the actuator 4.

A bottom surface 13 of the actuator 4 is provided with an inlet 14 (FIG. 1) leading to an internal central bore 16 which communicates with the centrally disposed primary discharge orifice 8 where the product contents are dispensed from the actuator 2 to the external environment and/or onto a desired object, e.g. a carpet, a floor, etc. The inlet 14 is defined by a chamfered surface 20 which facilitates engagement with a stem 22 of an aerosol valve 23 (only diagrammatically shown) attached to a mounting cup 24 (FIG. 1). The aerosol valve 23 is provided with an outlet passageway 25 which facilitates conveyance of the product contents, in a conventional manner, from the aerosol container 11, via a conventional dip tube 27 (shown in dashed lines), to the central bore 16 of the actuator 4. As the aerosol valve 23 is conventional and forms no inventive part of the present invention per se, and as the engagement between the inlet 14 of the actuator 4 and the stem 22 is well known in the industry, a further detailed description concerning the same is not provided.

The base 6 is provided with an exterior semicircular shaped annular recess 26 at a lower portion thereof remote from the actuator 4. The lower most surface of the base 6 is tapered or beveled, at 28, to assist with proper engagement and alignment between the annular recess 26 of the base 6 and an inwardly facing annular rim 29 surface of the mounting cup 24.

At least one cutout or notch section 30, preferably one or two pairs of opposed cutouts or notch sections 30 (FIG. 4), extending through both the annular recess 26 and the beveled surface 28 and are provided to facilitate radially inward biasing of those members as the base 6 is received within the mounting cup 24. Once the base 6 is fully received and properly positioned within the mounting cup 24, the lower most portion of the base 6 is allowed to re-expand and spring radially outwardly, due to its inherent resilience, to permanently retain the engagement between the base 6 and the mounting cup 24.

A shoulder 31 is provided on the base 6, remote from the beveled surface 28, and the shoulder 31 functions as a stop to prevent over-insertion of the base 6 within the mounting cup 24. A portion of the base 6, adjacent the shoulder 31 and remote from the beveled surface 28, is provided with an annular collar 32 which extends in an axial direction and at least partially surrounds or encases the actuator 4. The annular collar 32 has a first gap or collar opening 34 provided therein to facilitate both operation of the actuator 4, via actuation of the finger recess 10, and discharge of the product contents of the pressurized container 11, of which a further discussion concerning the same will follow below.

The base 6 has a through bore 36 extending there-through which defines a longitudinal axis LA of the actuator assembly 2. The actuator 4 is located within the through bore 36 and is permanently secured to an inwardly facing surface of the through bore in a cantilevered fashion, e.g. a pivot arm 38, which allows up and down actuation (see the double end arrow in FIGS. 1 and 4–6) of the actuator 4, and a further discussion concerning the same will follow.

As seen in FIGS. 2 and 3, the top surface 12 of the actuator 4 supports a retaining post 40, e.g. a screw, a snap rivet or a split post with an annular retaining barb 43, and a pair of spaced apart stops 42, 44, e.g. a first stop 42 and a second stop 44. A rotatable secondary actuator mechanism 46, e.g. a pivoted switch plate, is provided with a central aperture 48 which is sized to have a snug captive retaining fit or engagement with the post 40, supported by the top surface 12 of the actuator 4, and be permanently retained thereby in a conventional manner. Alternatively, the central aperture 48 may be a threaded bore sized to engage with the screw which forms the post 40.

The rotatable secondary actuator mechanism 46 is a generally planar member, having a thickness of between about 1/16 inch and about 1/8 inch, and includes an operable lever end 50 and an opposed spray end 52. The spray end 52 is provided with a secondary discharge orifice 54 for imparting a different spray pattern from that of the primary discharge orifice 8, and a further detailed description concerning the same will follow. The lever end 50 is shaped or formed so as to be easily activated by a single finger or thumb of a user to facilitate operation of the rotatable secondary actuator mechanism 46, i.e. movement of the rotatable secondary actuator mechanism 46 to and from the first inactive position (FIG. 2), sufficiently spaced from the primary discharge orifice 8, and the second active position (FIG. 3) communicating with the primary discharge orifice. The lever end 50 can extend radially past the annular collar 32, e.g. a fraction of an inch or so, to facilitate operation of the rotatable secondary actuator mechanism 46.

The first and second stops 42, 44 are formed in the annular collar 32 to limit or constrain movement of the rotatable secondary actuator mechanism 46 between the first inactive position, in which the rotatable secondary actuator mechanism 46 is located adjacent or in contact with the first stop 42 (FIG. 2) and clear of the centrally disposed primary discharge orifice 8, and a second active position, in which the rotatable secondary actuator mechanism 46 is located adjacent or in contact with the second stop 44 (FIG. 3) and is superimposed and overlays the centrally disposed primary discharge orifice 8. As can be seen in FIGS. 2 and 3, a portion of the annular collar 32 is removed or cut away to form two opposed surfaces which function as the first and second stops 42,44. With the rotatable secondary actuator mechanism 46 in the second active position, the primary discharge orifice 8, the actuator 4, the rotatable secondary actuator mechanism 46 and the secondary discharge orifice 54 all combine with one another to form an intermediate cavity 56 which supplies the product to be dispensed from the primary discharge orifice 8 to the secondary discharge orifice 54 where the spray characteristics of the product to be dispensed are altered as the product to be dispensed is dispensed via the secondary discharge orifice 54.

It is to be appreciated that the primary and secondary discharge orifices 8, 54, can be formed in any shape necessary to provide a desired exiting spray pattern or configuration of the product being discharge from the pressurized container.

According to the first embodiment of the invention, the primary discharge orifice has a rectangular shaped opening, i.e. about 0.035 inch long by about 0.016 inch wide opening, to facilitate a fan spray arrangement. That is, the product to be dispensed passes through the valve stem 22 and the inlet 14 and is forced out through the primary discharge orifice 8 to emanate as wide fan spray having a wide range of coverage. Continued depression of the actuator 4, by the user, will allow continuous dispensing of the product, in a fan spray configuration, so long as the actuator 4 is sufficiently depressed and the rotatable secondary actuator mechanism 46 remains in its first inactive position adjacent the first stop 42 (FIG. 2).

The secondary discharge orifice 54 has a circular shaped opening, i.e. a diameter of between about 0.020 inch and about 0.040 inch, and more preferably a diameter of about 0.030 inch, to facilitate a concentrate conical spray configuration. That is, when the rotatable secondary actuator mechanism 46 is rotated in a generally counter-clockwise manner (as seen in FIG. 3), thereby superimposing the secondary discharge orifice 54 over and above the primary discharge orifice 8, the product to be dispensed passes through the valve stem 22 and the inlet 14 and is forced out through the primary discharge orifice 8 into the intermediate cavity 56. Thereafter, the product to be dispensed remains pressurized in the intermediate cavity 56 and is conveyed to the secondary discharge orifice 54 where the product emanates as a concentrated conical spray having a narrow conical area of coverage. Continued depression of the actuator 4, by the user, will allow continuous dispensing of the product, in a concentrate conical spray arrangement, so long as the actuator 4 is sufficiently depressed and the rotatable secondary actuator mechanism 46 remains in its second position against the second stop 44 (FIG. 3).

It is to be appreciated that the top surface 12 of the actuator 4 and the bottom surface 58 of the rotatable secondary actuator mechanism 46 engage with one another so as to provide an adequate seal therebetween for sealing the intermediate cavity 56 and facilitating conveyance of the product to be dispensed from the primary discharge orifice 8 to the secondary discharge orifice 54 where the product is ultimately discharged. An adequate seal is necessary to minimize the escape of more than a minimal amount of the product to be dispensed, between the joint or gap formed between the top surface 12 of the actuator 4 and the bottom surface 58 of the rotatable secondary actuator mechanism 46.

One method of providing an adequate seal is to form a counter bore or recess 60 in the top surface 12 of the actuator 4 and to provide a mating protrusion 61 on the bottom surface 58 of the rotatable secondary actuator mechanism 46 so that when the rotatable secondary actuator mechanism 46 is moved to the position of FIG. 3, the protrusion 61 and recess 60 will mate with one another and form a seal therebetween. To assist further with proper sealing of those two components, the top surface 12 of the actuator 4 can also be provided with a L-shape compression member 62 which has sufficient clearance to allow the spray end 52 of the rotatable secondary actuator mechanism 46 to pass thereby but an overhang leg 63 of the compression member 62 biases the top surface 64 of the rotatable secondary actuator mechanism 46 downwardly against the actuator 4 thereby to form an adequate seal between the rotatable secondary actuator mechanism 46 and the actuator 4. If desired, a leading edge of the overhang can be provided with a taper or beveled surface to facilitate engagement with the spray end 52 of the rotatable secondary actuator mechanism 46 as the secondary actuator mechanism 46 is rotated toward engagement with second stop 44.

Alternatively, if desired or necessary, an annular seal (not shown) can be provided around the primary discharge orifice 8, either on the top surface 12 of the actuator 4 or on the bottom surface 58 of the rotatable secondary actuator mechanism 46, to provide a fluid tight fit between those two components when the rotatable secondary actuator mechanism 46 is in its active position. Such annular seal will insure that there is generally no leakage between the actuator 4 and the rotatable secondary actuator mechanism 46 during dispensing of product via the secondary discharge orifice 54.

Figure 4:
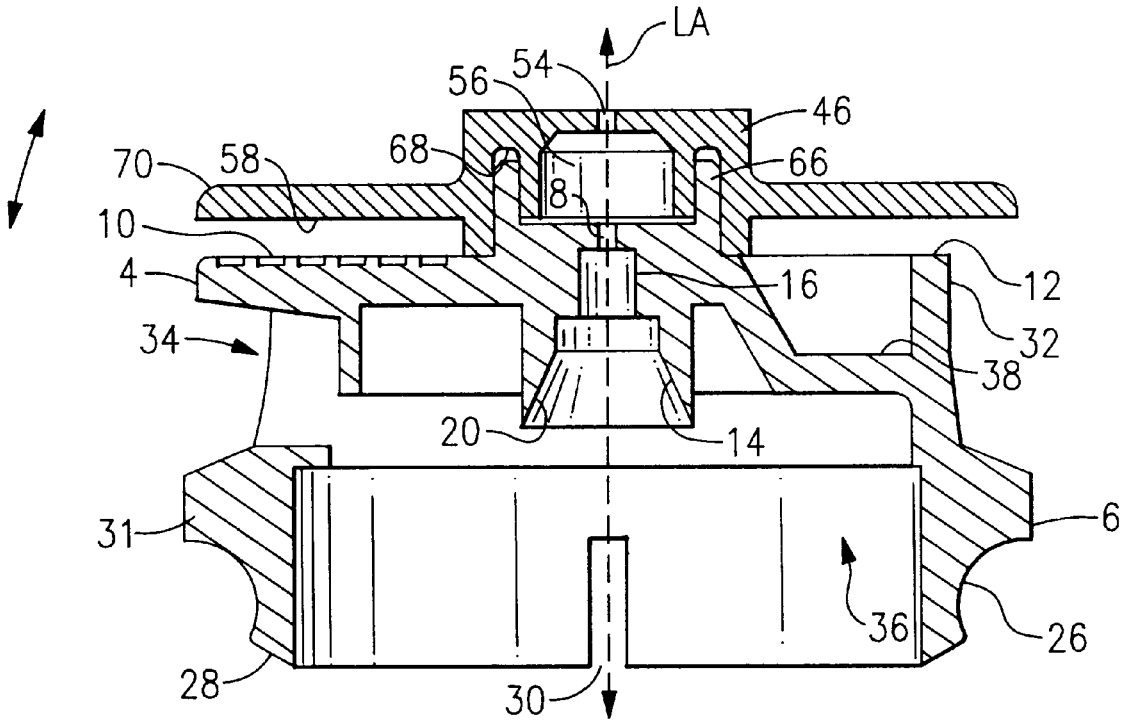
FIG. 4 is a diagrammatic cross-sectional view of a second embodiment of the valve assembly according to the present invention.

According to a second embodiment of the invention, as shown in FIG. 4, a completely removable secondary actuator mechanism 46 may be provided to overlay the primary discharge orifice 8 of the actuator 4. The secondary actuator mechanism 46, as shown in this Figure, is completely removable, replaceable and/or interchangeable with the actuator 4. To facilitate the releasable attachment of the removable secondary actuator mechanism 46 to the actuator 4, the actuator 4 is provided with a cylindrical shroud 66 which completely surrounds the primary discharge orifice 8. The bottom surface 58 of the removable secondary actuator mechanism 46 is provided with a mating annular recess 68 which has a slight interference fit with the shroud 66. In all other respects, this embodiment is substantially identical to the first embodiment.

In the second embodiment, when the removable secondary actuator mechanism 46 is affixed to the actuator 4, i.e. the shroud 66 engages with the annular recess 68 and the internal cavity 56 is defined by the top surface 12 of the actuator 4, the primary discharge orifice 8, the secondary discharge orifice 54 and the bottom and side surfaces of the removable secondary actuator mechanism 46 (which partially defines the annular recess 68). If so desired, the removable secondary actuator mechanism 46 can also have a finger actuator 70 which overlays the finger recess 10 of the actuator 4 to facilitate depression of the actuator.

It is to be appreciated that a plurality of removable secondary actuator mechanisms 46, each having different size or shaped secondary discharge orifice 54, can be provided and can be readily releasably attached to and overlay the primary discharge orifice 8 of the actuator 4. Each of the plurality of removable secondary actuator mechanisms 46 can facilitate spraying the product contents of the container 11 in a plurality of desired spray configurations.

When a user desires to alter the spray pattern from that provided by the primary discharge orifice 8, a desired one of the plurality of removable secondary actuator mechanisms 46 is placed over the actuator 4, i.e. by receiving the shroud 66 of the actuator 4 within the annular recess 68 of the removable secondary actuator mechanism 46. When a user depresses the actuator 4, via the finger actuator 70 and/or the finger recess 10, the product to be dispensed by the primary discharge orifice 8 is sprayed into the intermediate chamber 56, formed between the interface of the removable secondary actuator mechanism 46 and the actuator 4, and is conveyed to the secondary discharge orifice 54 where the product to be dispensed finally is discharged, via the secondary discharge orifice 54, in a desired spray configuration which is dictated by the size and/or shape of the secondary discharge orifice 54 formed in the attached secondary actuator mechanism 46.

Figure 5:
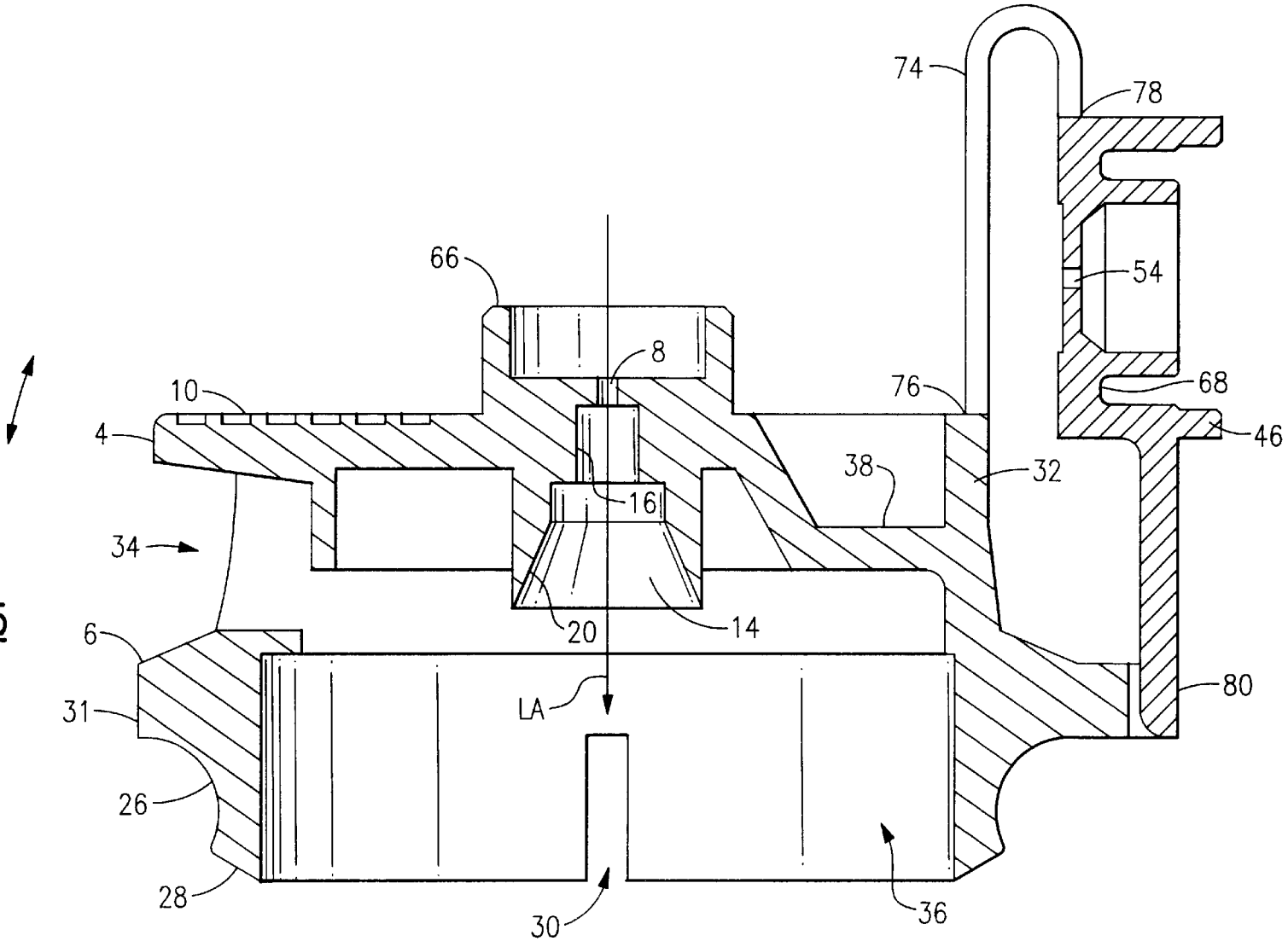
FIG. 5 is a diagrammatic cross-sectional view of a third embodiment of the actuator assembly, secured by a tether, shown in the inactive position.
Figure 6:
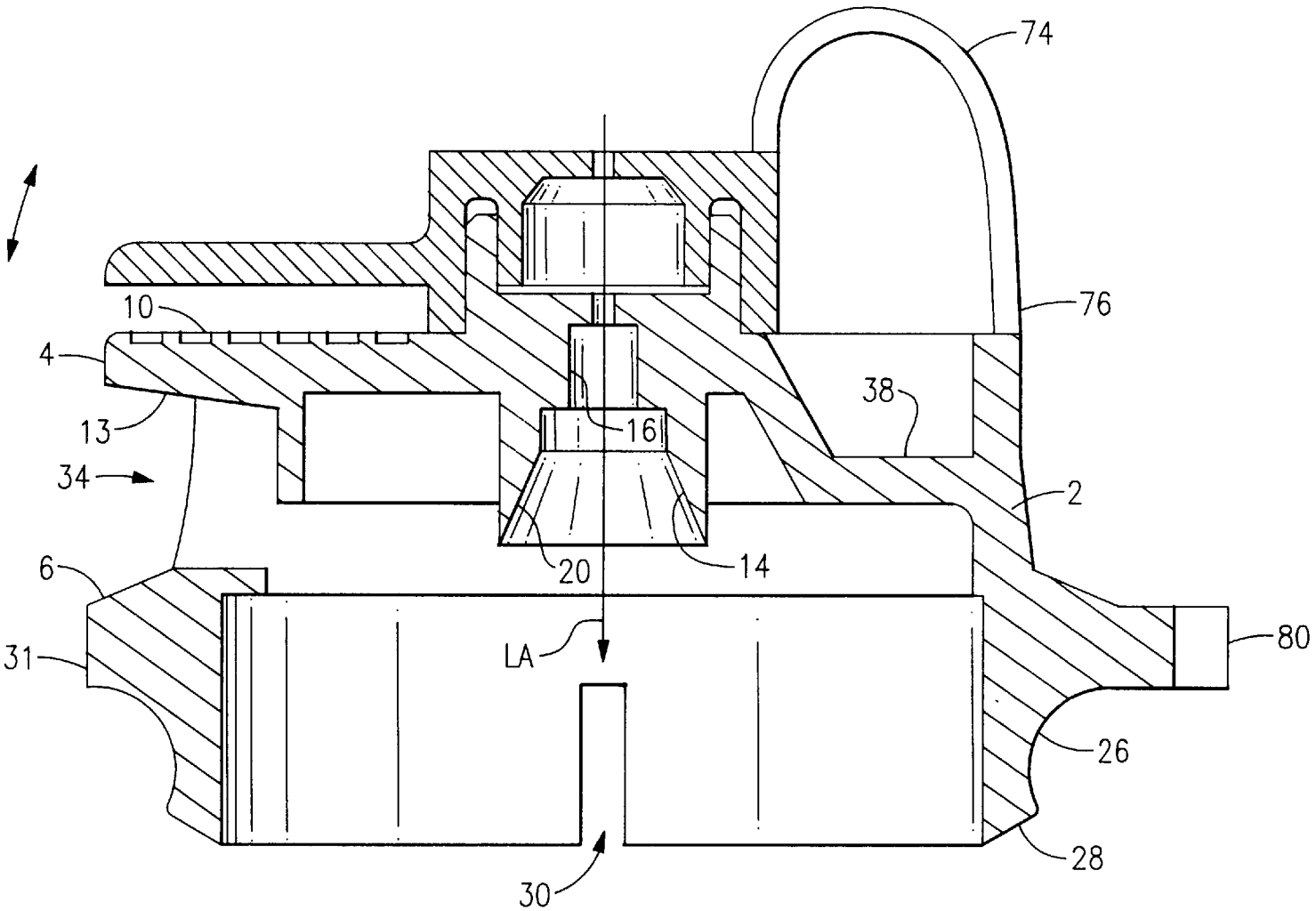
FIG. 6 is a diagrammatic cross-sectional view of the third embodiment of FIG. 5 showing the actuator in the active position.

A third embodiment of the invention is shown in FIGS. 5 and 6. As seen in these Figures, a removable secondary actuator mechanism of FIG. 4, similar to that described in the embodiment of FIG. 4, is provided with a tether 74. One end 76 of the tether 74 is permanently secured to the actuator 4, e.g. a portion of the collar 32, while an opposite end 78 of the tether 74 is permanently secured to the removable secondary actuator mechanism 46. The tether 74 attaches the removable secondary actuator mechanism 46 to the actuator assembly 2 and prevents the removable secondary actuator mechanism 46 from being accidently lost or misplaced.

FIG. 5 shows the tethered removable secondary actuator mechanism 46 disengaged from the actuator 4 (i.e. in the inactive position) and located in an actuator mechanism holster 80, e.g. an aperture, formed in the shoulder 31 of the base. When the removable secondary actuator mechanism 46 is located in actuator mechanism holster 80, the product to be dispensed by is influenced solely by the primary discharge orifice 8 of the actuator 4. FIG. 6 shows the tethered removable secondary actuator mechanism 46 secured to the actuator 4 by engagement between the shroud 66 with the annular recess 68. With the removable secondary actuator mechanism 46 in this position, the flow characteristics of the product to be dispensed are controlled and dictated by the secondary discharge orifice 54.

Since certain changes may be made in the above described actuator assembly for an aerosol container, without departing from the spirit and scope of the invention herein involved, it is intended that all of the subject matter of the above description or shown in the accompanying drawings shall be interpreted merely as examples illustrating the inventive concept herein and shall not be construed as limiting the invention.

Wherefore, I claim:

1. An actuator assembly for an aerosol container having a stem for controlling dispensing of an aerosol product, the actuator assembly comprising:

a base defining a longitudinal axis of the actuator assembly and having a through bore extending therethrough, and the base having an annular mechanism for attaching the base to a mounting cup of an aerosol container containing an aerosol product; and an actuator being located within the through bore of the base, the actuator being cantilevered to the base to facilitate pivoting of the actuator relative to the base, and the actuator having a product inlet and a primary discharge orifice, both communicating with one another, for dispensing the aerosol product out through the primary discharge orifice when the actuator assembly is attached to an aerosol container and sufficiently depressed;

wherein the actuator assembly includes a secondary actuator mechanism provided with a secondary discharge orifice, and the secondary actuator mechanism, has a first inactive position in which the secondary discharge orifice of the secondary actuator mechanism is sufficiently spaced from the primary discharge orifice so that a spray configuration of the aerosol product to be dispensed is controlled solely by the primary discharge orifice, and has a second active position, located adjacent the primary discharge orifice, in which the primary discharge orifice supplies the aerosol product to be dispensed to the secondary discharge orifice where the spray configuration of the aerosol product to be dispensed is altered by the secondary discharge orifice as the product exits the actuator assembly.

2. The actuator assembly according to claim 1, wherein the actuator is provided with a rectangular shaped primary discharge orifice.

3. The actuator assembly according to claim 1, wherein the base is provided with an outwardly facing annular recess which engages with an inwardly facing surface of a mounting cup for attaching the actuator assembly to the aerosol container.

4. The actuator assembly according to claim 3, wherein the base includes a collar located remote from the annular recess, and the collar includes a collar opening which accommodates a lever end of the actuator to facilitate actuation of the actuator and dispensing of the aerosol product.

5. The actuator assembly according to claim 4, wherein the secondary discharge orifice has a circular shaped opening with a diameter of between about 0.020 inch and about 0.040 inch to facilitate a conical spray discharge from the actuator assembly.

6. The actuator assembly according to claim 1, wherein the base includes an inner wall and an outer wall and the outer wall has an inwardly facing annular member which engages with one of a mounting cup and a rim of the aerosol container for securing the actuator assembly in place.

7. The actuator assembly according to claim 1, wherein the actuator is cantilevered to the base by a pivot arm to facilitate pivoting of the actuator relative to the base.

8. The aerosol container according to claim 1, wherein the base includes a shoulder to prevent over-insertion of the base into the mounting cup during installation of the actuator assembly.

9. The actuator assembly according to claim 1, wherein the product inlet communicates with a central bore provided within the actuator and the central bore abuts against a top surface of the stem to facilitate depression of the stem during operation of the actuator.

10. The actuator assembly according to claim 1, wherein at least one notch section is provided in the base to facilitate attaching the base to one of a rim of an aerosol container and a mounting cup.

11. The actuator assembly according to claim 1, wherein a top surface of the actuator is provided with a finger recess for accommodating a finger of a user to facilitate depression of the actuator.

12. The actuator assembly according to claim 1, wherein a pair of stops are provided on a top surface of the actuator to limit movement of the secondary actuator mechanism between the first inactive position and the second active position.

13. The actuator assembly according to claim 12, wherein the top surface of the actuator supports a post and the secondary actuator mechanism has an aperture therein which engages with the post to permanently attach the secondary actuator mechanism to the actuator while allowing movement of the secondary actuator mechanism between the first inactive position and the second active position.

14. The actuator assembly according to claim 1, wherein a top surface of the actuator supports an annular shroud and a bottom surface of the secondary actuator mechanism supports an annular recess which is sized to have an interference engagement with the shroud and releasably retain the engagement of between the secondary actuator mechanism and the actuator.

15. The actuator assembly according to claim 14, wherein the actuator assembly includes a tether which has one end thereof attached to the base and an opposite end of the tether is attached to the secondary actuator mechanism thereby to secure the secondary actuator mechanism to the base.

16. An actuator assembly in combination with an aerosol container;

the aerosol container comprising a substantially closed container being opened at one end thereof, a mounting cup closing the open end of the aerosol container and supporting a valve, a valve stem of the valve extending through an aperture of the mounting cup and a second end of the valve stem communicating with an interior of the aerosol container, via a passageway, for facilitating dispensing of an aerosol product from the aerosol container to the exterior environment;

the actuator assembly comprising:

a base defining a longitudinal axis of the actuator assembly and having a through bore extending therethrough, and the base having an annular mechanism for attaching the base to the mounting cup of the aerosol container containing the aerosol product; and an actuator being located within the through bore of the base, the actuator being cantilevered to the base to facilitate pivoting of the actuator relative to the base, and the actuator having a product inlet and a primary discharge orifice, both communicating with one another and the valve stem, for dispensing the aerosol product out through the primary discharge orifice;

wherein the actuator assembly includes a secondary actuator mechanism provided with a secondary discharge orifice, and the secondary actuator mechanism, has a first inactive position in which the secondary discharge orifice of the secondary actuator mechanism, is sufficiently spaced from the primary discharge orifice so that a spray configuration of the aerosol product to be dispensed is controlled solely by the primary discharge orifice, and, has a second active position, located adjacent the primary discharge orifice, in which the primary discharge orifice supplies the aerosol product to be dispensed to the secondary discharge orifice where the spray configuration of the aerosol product to be dispensed is altered by the secondary discharge orifice as the product exits the actuator assembly.

17. The combination according to claim 16, wherein the actuator is provided with a rectangular shaped primary discharge orifice and the secondary discharge orifice has a circular shaped opening with a diameter of between about 0.020 inch and about 0.040 inch to facilitate a conical spray discharge from the actuator assembly.

18. The actuator assembly according to claim 16, wherein the actuator is cantilevered to the base by a pivot arm to facilitate pivoting of the actuator relative to the base;

the base includes a collar located remote from an annular recess, and the collar includes a collar opening which accommodates a lever end of the actuator to facilitate actuation of the actuator and dispensing of the aerosol product; and the base includes a shoulder to prevent over-insertion of the base into the mounting cup during installation of the actuator assembly.

19. The actuator assembly according to claim 16, wherein the product inlet communicates with a central bore provided within the actuator and the product inlet abuts against a top surface of the valve stem to facilitate depression of the valve stem during actuation of the actuator; and at least one notch section is provided in the base to facilitate attaching the base to the mounting cup.

20. The actuator assembly according to claim 16, wherein a top surface of the actuator is provided with a finger recess for accommodating a finger of a user to facilitate depression of the actuator.

* * * * *